US007700862B2

(12) United States Patent
Schwarze et al.

(10) Patent No.: US 7,700,862 B2
(45) Date of Patent: Apr. 20, 2010

(54) METHOD OF IMPROVING THE ACOUSTIC CHARACTERISTICS OF RESONANT WOOD FOR MUSICAL INSTRUMENTS

(75) Inventors: Fancis W. M. R. Schwarze, St. Gallen (CH); Martin Schleske, Grubmühl 22, 82131 Stockdorf (DE)

(73) Assignee: Martin Schleske, Stockdorf (DE)

( * ) Notice: Subject to any disclaimer, the term of this patent is extended or adjusted under 35 U.S.C. 154(b) by 747 days.

(21) Appl. No.: 11/450,358

(22) Filed: Jun. 12, 2006

(65) Prior Publication Data

US 2006/0278061 A1 Dec. 14, 2006

(30) Foreign Application Priority Data

Jun. 14, 2005 (DE) ..... 10 2005 027 424

(51) Int. Cl.
*G10D 3/00* (2006.01)

(52) U.S. Cl. ..... 84/291

(58) Field of Classification Search ..... 84/267, 84/290, 291

See application file for complete search history.

(56) References Cited

U.S. PATENT DOCUMENTS

| | | | | |
|---|---|---|---|---|
| 2,838,424 | A * | 6/1958 | Depew et al. | 427/297 |
| 5,538,670 | A * | 7/1996 | Ritschkoff et al. | 252/400.22 |
| 6,667,429 | B2 | 12/2003 | Abe et al. | |

FOREIGN PATENT DOCUMENTS

| | | |
|---|---|---|
| DE | 239 142 | 10/1911 |
| DE | 333 235 | 2/1921 |
| DE | 375687 | 5/1923 |
| DE | 444 616 | 5/1927 |
| DE | 445 178 | 6/1927 |
| DE | 20 55 164 | 11/1970 |
| EP | 0 363 559 | 4/1990 |

OTHER PUBLICATIONS

Bunce and Hunt; How Do You Make A Better Violin?; Oct. 7, 1987; The Science Corner [online]; http://www.physics.uoguelph.ca/summer/scor/articles/scor166.htm.

Helfferich; Songs from Alaska's Spruce, Oct. 24, 1990; Alaska Science Forum [online]; http://web.archive.org/web/20041012215419/http://www.gi.alaska.edu/ScienceForum/ASF10/1001.html.

Obataya et al.; Vibrational Properties of Wood Along the Grain; 2000; pp. 2993-3001; vol. 35; Journal of Materials Science.

* cited by examiner

*Primary Examiner*—Kimberly R Lockett
(74) *Attorney, Agent, or Firm*—Stites & Harbison PLLC; Ross F. Hunt, Jr.

(57) ABSTRACT

Method of improving the acoustic characteristics of resonant wood for musical instruments, characterised in that during a limited period of treatment the resonant wood is exposed to the action of a type of fungus which decomposes wood, wherein the type of fungus and the period of treatment are chosen in such a way that by the treatment on the one hand an increase in the ratio of velocity of sound of the wood to bulk density of the wood is achieved and on the other hand strength values of the resonant wood do not fall below predetermined minimum values. The invention also relates to a resonant wood for musical instruments, with predetermined minimum strength values of the resonant wood, wherein treatment over a limited time by means of a type of fungus which decomposes wood treatment increases the ratio of velocity of sound of the wood to bulk density of the wood.

14 Claims, 5 Drawing Sheets

METHOD OF IMPROVING THE ACOUSTIC CHARACTERISTICS OF RESONANT WOOD FOR MUSICAL INSTRUMENTS

The invention relates to a method of improving the acoustic characteristics of resonant wood for musical instruments, hereafter referred to as resonant wood, which has been treated by this method, as well as musical instruments, preferably bowed stringed instruments, of which the soundboards are made from such resonant wood.

Resonant wood for musical instruments should be as light as possible, but at the same time should have a high modulus of elasticity (or Young's modulus) and a high velocity of sound. It should also be knotless and should have narrow homogeneous annual rings as well as a low proportion of late wood (<20%). Only a few carefully selected ranges of woods meet these strict quality criteria.

Musical instruments which were built during the later 17th century and early 18th century frequently have better quality characteristics than contemporary instruments. In order to explain this difference in quality a number of hypothesis have already been proposed, one of which attributes the special wood quality of these instruments to the climatic situation known as the Maunder Minimum which prevailed between 1645 and 1715 and in which the longer winders and cooler summers caused a slower and more even formation of wood and thus a low proportion of late wood. During the last decades of his creativity (the so-called "golden era") the famous violin maker Antonio Stradivari used predominantly spruce from trees which were grown during the Maunder Minimum. For a long time these instruments have been regarded as an ideal for sound which has only rarely been achieved again.

The (acoustic) material quality Mq of resonant wood is generally defined by the quotient $c/\rho$, where c represents the velocity of sound and $\rho$ represents the bulk density of the resonant wood. The velocity of sound corresponds to the square root of the ratio of the modulus of elasticity (for bending along the fibre) to density. The modulus of elasticity is a material value which is independent of the geometry, the product of modulus of elasticity and area moment gives the bending strength of the workpiece.

The velocity of sound of spruce in the longitudinal direction amounts to 4800 to 6200 m/s, and the bulk density is 320 to 420 kg/m$^3$.

In all measures taken for improvement of the material quality Mq the influence which relative changes of the modulus of elasticity and bulk density have on the velocity of sound is of particular interest: If in a particular step the modulus of elasticity (in %) changes approximately proportionally with the change in the bulk density (in %), then the velocity of sound remains almost the same (the material quality then increases in inverse proportion to a reduction in the bulk density; such a ratio of relative changes of modulus of elasticity and bulk density is defined as "narrow". On the other hand, if in a particular step the modulus of elasticity (in %) is reduced substantially less than the bulk density (in %), then the velocity of sound is increased (the material quality then increases more than in inverse proportion to a reduction in the bulk density); such a ratio of relative changes of modulus of elasticity and bulk density is defined as "wide" or "large" and is very desirable in order to achieve a high material quality Mq of resonant wood. However, resonant wood with a wide ratio of modulus of elasticity to bulk density is very rare in nature and consequently expensive.

Traditionally in violin-making various methods are used in order to improve the material quality of soundboards made from wood (particularly from spruce, which is generally used for the top-plate of the body). Studies show, however, that these conventional methods of treatment (using primers, varnishes and mineral substances) do increase the modulus of elasticity but due to the cell closure associated with the treatment they frequently also lead to an increase in the density or vibrating mass of the wood.

A perceptible and reliable improvement in the material quality of resonant wood cannot generally be achieved by these methods.

If the soundboard of the musical instrument is to be made not from solid wood but as a composite fibre sandwich plate, EP 01 119 531 describes a promising proposal for the improvement of the acoustic quality of the instrument. In this case a composite fibre sandwich plate with a high quotient of velocity of sound to density is used, wherein the area of the soundboard bounded by the outline of the soundboard is chosen to be so great that the frequency of the main body resonance lies in an ideal sound range.

By contrast, the object of the present invention is to develop a method by which the acoustic characteristics of resonant wood for musical instruments can be improved.

This object is achieved according to the invention in that during a limited period of treatment the resonant wood is exposed to the action of a type of fungus which decomposes wood, wherein the type of fungus and the period of treatment are chosen in such a way that by the treatment on the one hand an increase in the ratio of velocity of sound of the wood to bulk density of the wood is achieved and on the other hand strength values of the resonant wood do not fall below predetermined minimum values.

Due to the wood-decomposing action of the fungi the bulk density of the wood is markedly reduced, but on the other hand the modulus of elasticity is not significantly lowered. This results in an increase in the velocity of sound with a simultaneous reduction in the density. According to the relations referred to above, this results in a marked improvement in the material quality of the resonant wood. The greater ratio of modulus of elasticity to bulk density which is achieved by such a wood decomposition process leads to a similar material quality of the wood to that possessed by wood from trees which grew during the Maunder Minimum.

BRIEF DESCRIPTION OF THE DRAWINGS

FIGS. 1A, 1B and 1C show different wood structures;

FIG. 1A shows a row of cells of normal softwood. Broad annual rings can be seen with a uniform proportion of thick-walled late wood tracheids and thin-walled early wood tracheids.

FIG. 1B shows particularly high-quality old spruce resonant wood which grew during the Maunder Minimum. The annual rings are narrow and consist predominantly of early wood tracheids with only one row of cells of late wood tracheids.

Finally, FIG. 1C shows an early stage in the decomposition of the wood with few pits. The annual ring is narrow. First changes to the structure due to wood-decomposing fungi are discernible. At this stage a certain reduction in the bulk density can already be observed. A late stage of the wood decomposition (with many pits) is shown on the right in FIG. 1C. The cell walls of the late and early wood have become perceptibly thinner.

Figure 1:
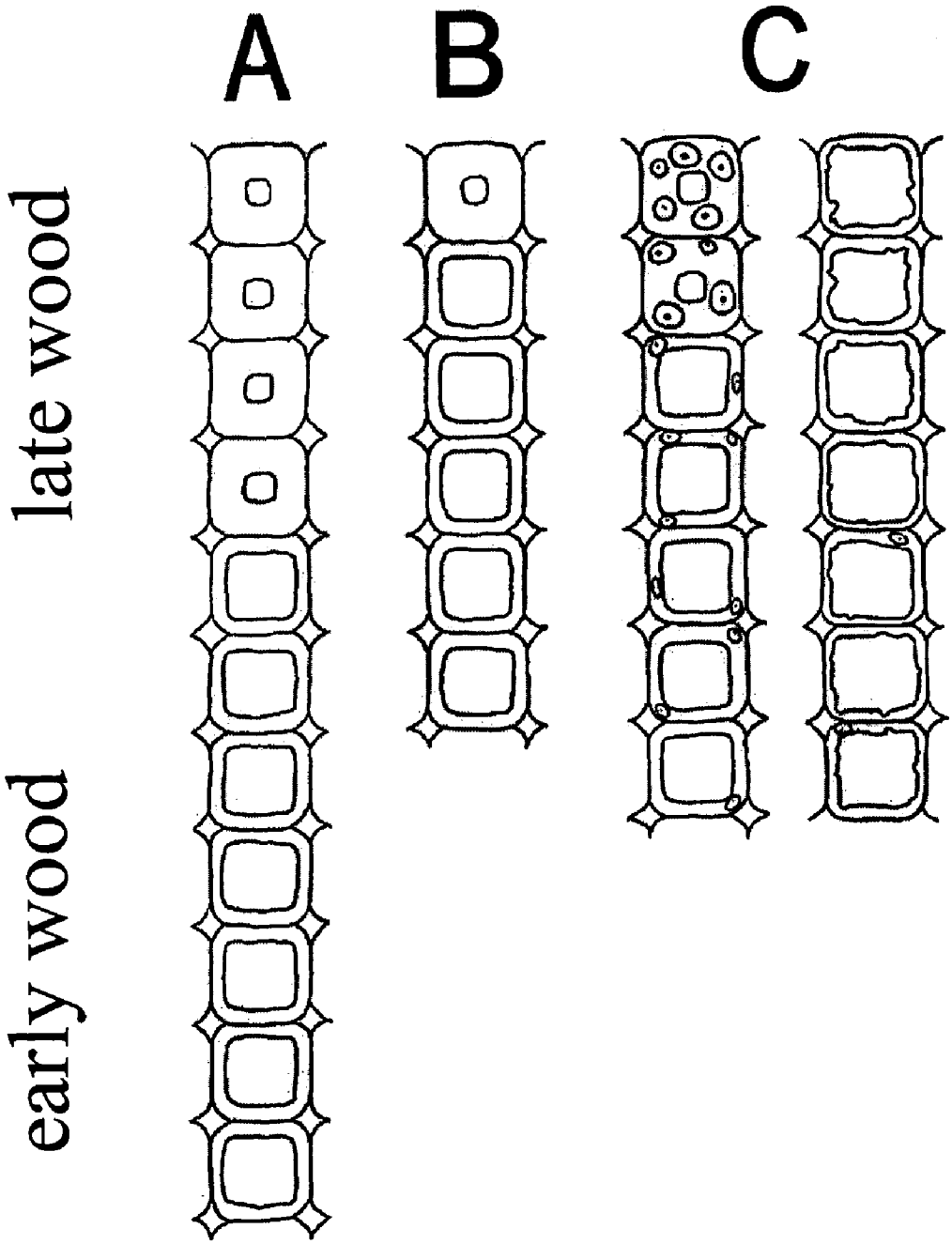
FIG. 1 shows schematically the different wood structure of normal softwood (FIG. 1A), of particularly high-quality extremely rare resonant wood (FIG. 1B) and of resonant wood treated according to the invention (FIG. 1C).

Thus during the treatment with fungi for the decomposition of the wood the bulk density of the wood decreases as the degree of decomposition increases. Therefore as the modulus of elasticity is simultaneously retained or only slightly reduced the velocity f the sound increases and consequently so also does the material quality Mq.

However, in the fungus treatment for decomposition of the wood care must at the same time be taken to ensure that after the treatment the wood still has the predetermined minimum strength values which are necessary for violin making. These include in particular a specific minimum value of the modulus of elasticity (for bending along the fibre) as well as certain minimum values for the compression strength (along and across the fibre). In this respect the strength values of the resonant wood should advantageously not fall below the following minimum values:

Modulus of elasticity for being along the fibre (in GPa)
- spruce: 7, preferably 10,
- maple: 4, preferably 5.8,
- poplar: 4, preferably 5.5, Compression strength along the fibre (in $N/mm^2$ or MPa)
- spruce: 24, preferably 34,
- maple: 27, preferably 38,
- poplar: 16, preferably 23, Compression strength across the fibre (in $N/mm^2$ or MPa)
- spruce: 3, preferably 4.2,
- maple: 6, preferably 11,
- poplar: 1.5, preferably 2.1.

The lower minimum strength values given above correspond to approximately 50% and the preferred raised minimum strength values correspond to approximately 70% of the strength values of the untreated wood.

Thus according to the invention the duration of the wood-decomposing fungus treatment is advantageously chosen to be such that it lasts until on the one hand the ratio of velocity of sound to bulk density has reached a maximum value (which is for instance the case when the volume of the pits is at a maximum), but on the other hand the strength values of the wood have not fallen below the predetermined minimum values.

The method according to the invention not only improves the acoustic characteristics of the resonant wood but also leads to a further significant advantage which is of considerable practical importance precisely when this resonant wood is used for musical instruments. Due to the wood-decomposing action of the fungi the hygroscopic characteristics of the wood are also markedly improved. Wood is known to be hygroscopic, whereby the absorption or emission of moisture (in adaptation to the ambient climate) leads respectively to swelling or shrinkage of the wood and thus also to more or less great changes in shape. Under extreme environmental conditions, e.g. in air-conditioned rooms, in aircraft or concert halls, changes in the relative humidity can occur so abruptly and drastically that high stresses occur in the soundboards of musical instruments and cracks and serious impairments of the acoustic characteristics occur.

In the fungus treatment for decomposition of the wood the hydroxyl groups in the wood which are responsible for the swelling and shrinking of the wood are split off by enzymatic processes, so that the hygroscopicity of the resonant wood is markedly reduced. Musical instruments made from resonant wood which has been treated by the method according to the invention are therefore much less susceptible to substantial fluctuations in the relative humidity of the surroundings than are musical instruments in which the soundboard is made from conventional resonant wood.

The invention is explained in greater detail with reference to some embodiments and test results.

Types of fungus which cause mildew are of particular interest for the method according to the invention. Their thread-like hyphae preferably grow within the so-called secondary wall of the cells. The decomposition of the wood leads to the formation of pits in the secondary wall, so that the density of the wood decreases.

The cell walls are decomposed to some extent from the interior, whilst the middle layer, comprising the middle lamella and primary wall, is retained. It contains lignin and pectin, a glue-like substance which holds the cells together. An intact middle layer is important for a high modulus of elasticity of the resonant wood. Thus a fungus which selectively breaks down the secondary wall leads to wood which is lighter but has a relatively high modulus of elasticity. In this way the characteristics which distinguish the particularly good resonant wood can be specifically achieved.

In the extensive tests on which the invention is based, for the improvement of the acoustic characteristics of resonant wood (sterilised wood samples of maple and spruce) in particular Asco-und Basidiomycetes (class) from the family of Leotiaceae, Polyporaceae, Schizophyllaceae, Tricholomataceae and Xylariaceae are used for the incubation of the wood samples. Further details of the type of fungi used are to be found in the following Table 1. It contains the types of fungi, the family, the strain numbers and the preferred type of wood (host) which are used for the purpose of improving resonant wood.

| Type of fungus | Family | Source | Host |
|---|---|---|---|
| *Xylaria longipes* | Xylariaceae | Empa strain 651 | maple |
| *Kretzschmaria deusta* | Xylariaceae | Empa strain 652 | maple |
| *Armillaria cepistipes* | Trichlomataceae | Empa strain 655 | maple, spruce |
| *Climacocystis borealis* | Polyporaceae | Empa strain 656 | spruce |
| *Climacocystis borealis* | Polyporaceae | Empa strain 657 | spruce |
| *Phialocephala fortinii* | Leotiaceae | Empa strain 658 | spruce |
| *Phialocephala fortinii* | Leotiaceae | Empa strain 659 | spruce |
| *Schizophyllum commune* | Schizophyllaceae | Empa strain 595 | maple, spruce |
| *Polyporus squamosus* | Polyporaceae | Empa strain 650 | maple |

The chosen types of fungus occur naturally on spruce (*Picea abies*) and maple (*Acer platanoides* and *Acer psedolatanus*), that is to say on woods which are traditionally used as soundboards (top-plate and back-plate) in violin making. Our own studies show that by comparison with many other causes of rot the pattern of decomposition of the wood of the chosen types of fungi does not significantly change the propagation of the sound waves in the decomposed wood. This is explained by the fact that during the breakdown of the wood the bulk density decreases more than the modulus of elasticity. Moreover, the middle layer of the wood cells has a very high concentration of guaiacyl lignin which is particularly durable against the chosen types of the fungus. For this reason, even in the late stage of the decomposition of the wood a highly lignified structure is retained which consists of the cell walls of the vessels, the middle layer of fibres, of rays and parenchyma cells.

Figure 2:
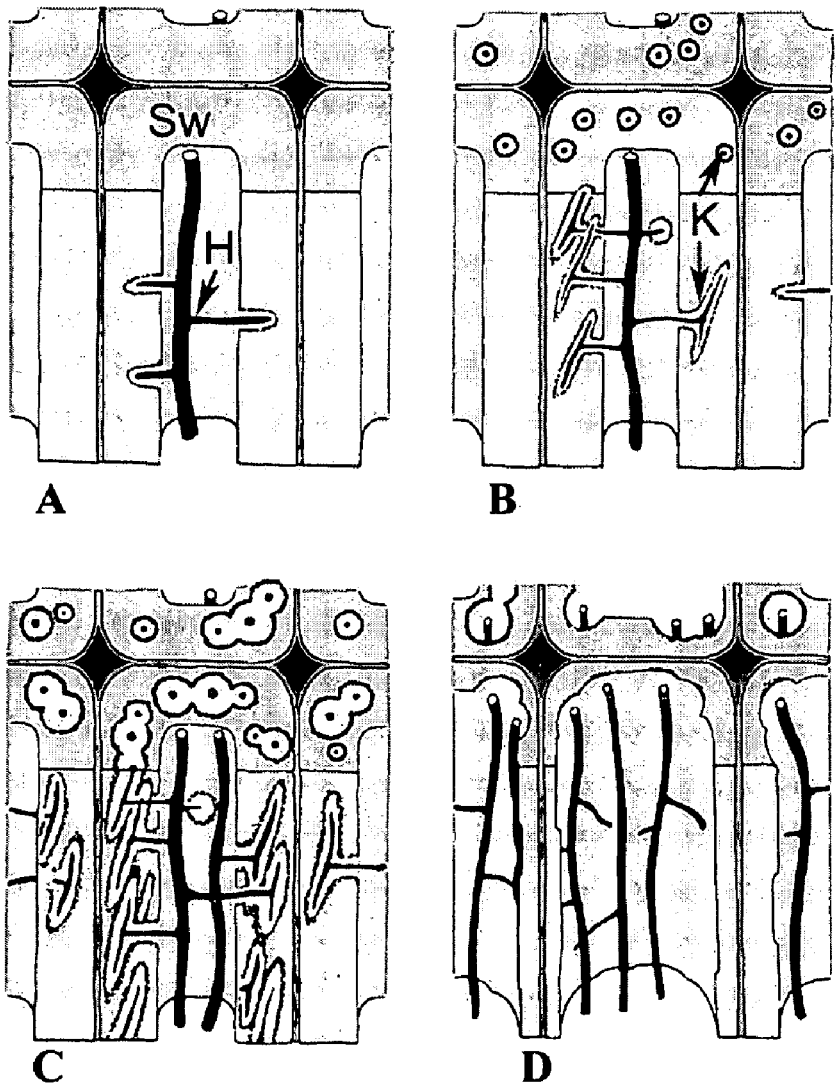
FIGS. 2A, 2B, 2C and 2D show wood structures in different stages of decomposition.

FIG. 2 shows these relationships in schematic form in somewhat greater detail.

As FIG. 2A shows, during the wood treatment individual hyphae H penetrate into the cell wall and grow within the cell wall along the alignment of the cellulose microfibrils (which are not visible with an optical microscope).

FIGS. 2B and 2C show the enzymatic breakdown of the cell wall around the hyphae H. It leads to the production of pits K with conically formed ends.

In the late stage of the wood decomposition (FIG. 2D) the secondary wall Sw is almost completely broken down, but the middle layer is retained. The remaining structure and the fact that no holes are caused by hyphae H still give the wood a very high modulus of elasticity even in the late stage of breakdown.

Figure 3:
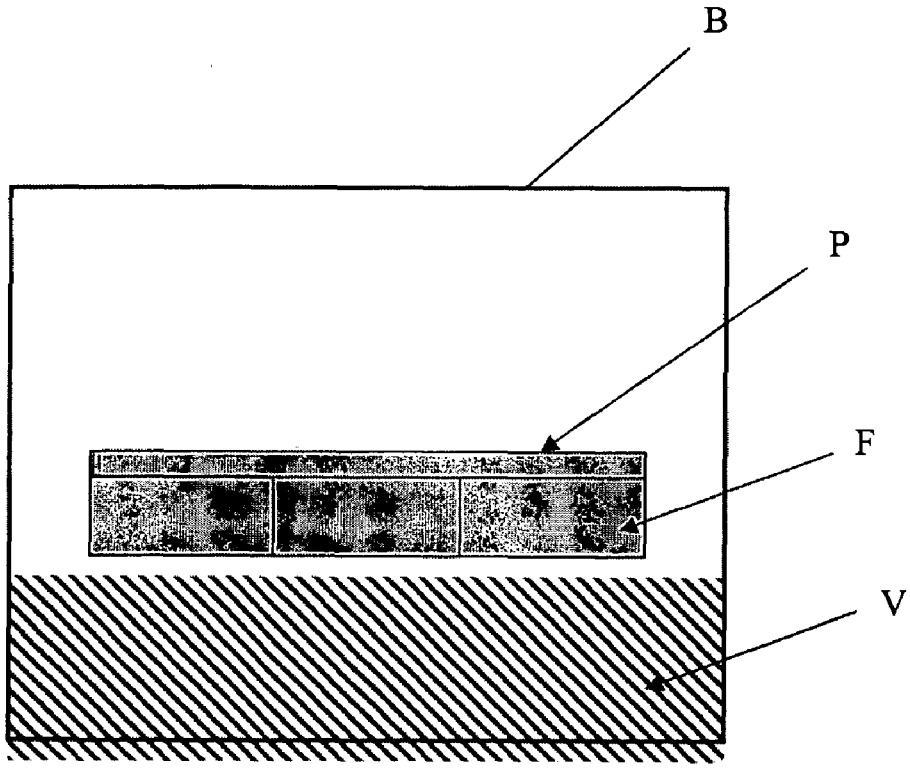
FIG. 3 shows an apparatus for the treatment of resonant wood.

FIG. 3 shows schematically a simple apparatus for carrying out the method according to the invention. The incubation of wood samples P takes place in a closed plastics container B over previously infected liner boards F which are located over vermiculite. From the infected liner boards the causes of rot colonise the wood samples. The mineral rock vermiculite serves as a moisture source for the hyphae of the fungus.

First of all the liner boards are sterilised with ethylene oxide (1 hour; 0.65 bars, 55° C.; approximately 1200 mg $C_2H_4O$/l). Kolle plates with 75 ml 2.5% MEA (malt extract agar) are injected with pure cultures of the types of fungus used. After the fungus mycelium has grown on the Kolle plates for 4 weeks the sterilised maple and spruce liner boards 50×25×15 mm) are incubated for 6 weeks at 70% RH und 22° C.

Vermiculite (VTT Vermisol Type M, particle size 1-3 mm; particles under 1 mm are screened out) is used as moisture substrate. The water content of vermiculite is set with buffer solution (950 ml 011 M KCl+50 ml 0.1 M HCl) to a moisture content which corresponds to 100% of the average water holding capacity (whcl).

For each test container 60 g of vermiculite (approximately 500 ml) are added and slightly compressed. The samples are exposed at 22±1° C. and 70±5% relative humidity and for 4, 8 and 12 weeks. After the treatment and the removal of the adhering fungus mycelium residues the weight loss due to fungus attack is determined on the base of the starting and final kiln-dry weight. The improvement in the material quality Mq is determined by means of characteristic frequency measurements.

Figure 4:
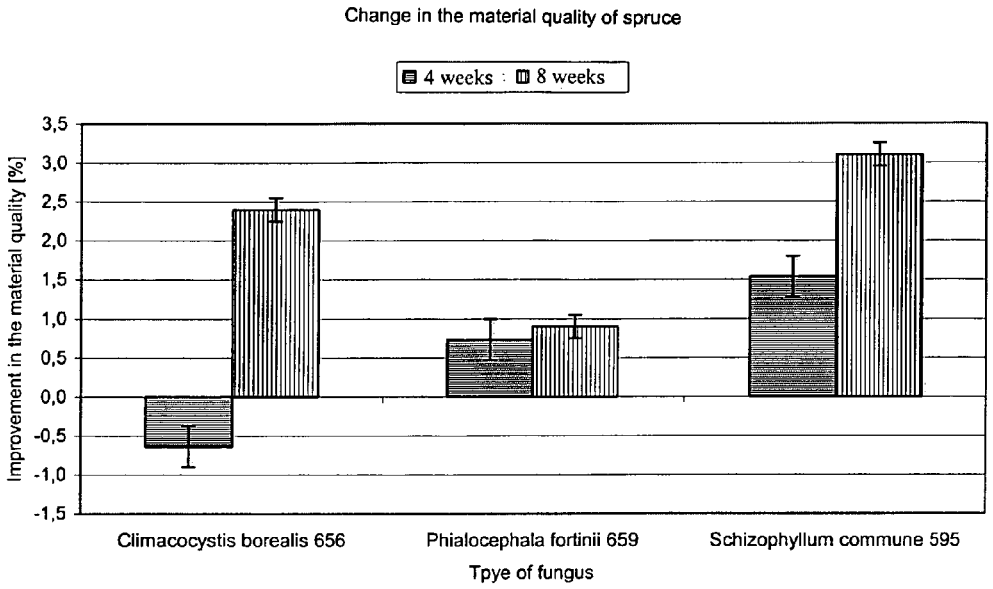
FIGS. 4 and 5 show the change of quality of spruce and maple when treated according to one aspect of the invention.

FIG. 4 shows the change in the material quality Mq of spruce resonant wood when treatment with three types of fungus listed in Table 1. The percentage improvement in the material quality Mq of the studied spruce resonant wood samples is most marked in treatment with *Schizophyllum commune* 595 and a duration of treatment of 8 weeks.

Figure 5:
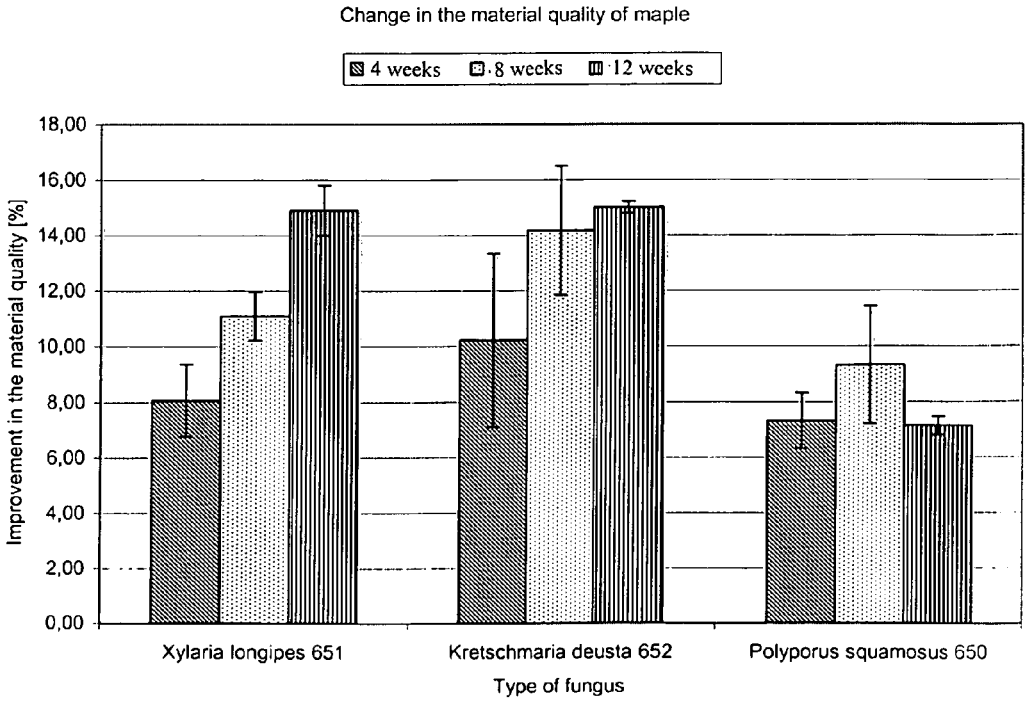

FIG. 5 shows the change in the material quality Mq of maple resonant wood with three other types of fungus listed in Table 1. The percentage improvement in the material quality Mq of the studied maple resonant wood samples is particularly marked in treatment with *Xylaria longipes* 651 or with *Kretschmaria deusta* 652, in each case with a duration of treatment of 12 weeks. When *Polyporus squamosus* 650 is used with exposure lasting more than 8 weeks a drop in the material quality Mq may again be observed.

The following Table 2 shows the dimensions of resonant wood samples before and after the fungus treatment and the loss of mass which has occurred (reduction in the density). In this AL=longitudinal maple sample, FL=longitudinal spruce samples.

| | | | Before the fungus treatment | | | | | After the fungus treatment | |
|---|---|---|---|---|---|---|---|---|---|
| Sample | Type of wood | Fungus | thickness [mm] | width [mm] | length [mm] | weight [g] | density [kg/m$^3$] | density [kg/m$^3$] | loss of mass [%] |
| AL14 | maple | 651 | 2.73 | 25.51 | 155.95 | 7.27 | 637 | 609 | 6.85 |
| AL19 | maple | 651 | 2.79 | 25.46 | 156.04 | 7.46 | 654 | 574 | 12.00 |
| AL22 | maple | 652 | 2.88 | 25.53 | 155.63 | 7.56 | 665 | 561 | 13.16 |
| AL29 | maple | 652 | 2.84 | 25.41 | 156.16 | 7.27 | 636 | 504 | 17.81 |
| AL33 | maple | 650 | 2.89 | 25.40 | 156.17 | 7.68 | 657 | 641 | 6.41 |
| FL16 | spruce | 656 | 3.05 | 27.20 | 149.8 | 5.57 | 448 | 422 | 4.09 |
| FL40 | spruce | 659 | 3.02 | 27.23 | 150.54 | 5.66 | 457 | 446 | 1.31 |
| FL50 | spruce | 595 | 2.93 | 27.18 | 150.50 | 5.35 | 446 | 429 | 2.32 |
| FL51 | spruce | 595 | 2.93 | 27.27 | 150.69 | 5.33 | 443 | 423 | 2.10 |

In the following Table 3 the modulus of elasticity, the velocity of sound and the material quality Mq of the wood samples before and after the fungus treatment are listed. In this case AL=longitudinal maple sample, FL=longitudinal spruce samples.

| | Before the fungus treatment | | | After the fungus treatment | | |
|---|---|---|---|---|---|---|
| Sample | Modulus of elasticity [MPa] | Velocity of sound First mode [m/s] | Material quality Mq | Modulus of elasticity [MPa] | Velocity of sound First mode [m/s] | Material quality Mq |
| AL14 | 8480 | 3648 | 5.7 | 8770 | 3797 | 6.2 |
| AL19 | 7900 | 3476 | 5.3 | 7170 | 3533 | 6.2 |
| AL22 | 9210 | 3721 | 5.6 | 6320 | 3355 | 6.0 |

-continued

| Sample | Before the fungus treatment: Modulus of elasticity [MPa] | Velocity of sound First mode [m/s] | Material quality Mq | After the fungus treatment: Modulus of elasticity [MPa] | Velocity of sound First mode [m/s] | Material quality Mq |
|---|---|---|---|---|---|---|
| AL29 | 10600 | 4077 | 5.4 | 6970 | 3721 | 7.4 |
| AL33 | 8600 | 3618 | 5.5 | 9400 | 3829 | 9.0 |
| FL16 | 12645 | 5412 | 11.8 | 11083 | 5225 | 12.1 |
| FL40 | 14099 | 5572 | 12.1 | 13243 | 5490 | 12.2 |
| FL50 | 12059 | 5218 | 11.6 | 11021 | 5095 | 11.8 |
| FL51 | 11873 | 5217 | 11.7 | 10662 | 5058 | 11.9 |

Thus the tests show that due to the differing reductions in the bulk density, modulus of elasticity and velocity of sound the material quality Mq initially increases as the incubation time (exposure to fungus) increases and then drops again. Therefore, with increasing duration the reduction of the bulk density is insufficient to compensate for the reduction in the velocity of sound. As the incubation time increases the strength values of the resonant wood (modulus of elasticity and compression strength) initially remain approximately the same and then drop.

Thus the precise choice of the duration of treatment of the particular type of fungus used is of great importance. The type of fungus and the duration of treatment are tailored to one another in such a way that by the treatment on the one hand—by comparison with the untreated initial state—an increase in the radio of velocity of sound of the wood to bulk density of the wood (that is to say an increase in the acoustic material quality Mq) is achieved, but on the other hand the strength values of the resonant wood do not fall below predetermined minimum values.

The determination of the velocity of sound c and of the modulus of elasticity E is carried out with the aid of the following formulae:

$$\text{velocity of sound } c = \frac{0.98 * L^2 * f}{d}$$

where:

c represents the velocity of sound of the longitudinal waves in m/s,

L represents the length of a sample strip in m (for example 0.2 m), f represents the characteristic frequency of the first bending mode in Hertz (for example 459 Hz), d represents the thickness of the sample strip in m (for example 0.003 m).

In the said example this results in:

$$c = \frac{0.98 * (0.2)^2 * 459}{0.003} = 6000$$

modulus of elasticity $E = c^2 * \delta$ where:

E represents the modulus of elasticity for bending (or "Young's modulus"), c represents the velocity of sound of the longitudinal waves in m/s, δ represents the density in kg/m$^3$ (for example 400 kg/m$^3$).

In the said example this results in:

$$E = 6000^2\left(\frac{\text{m}}{s}\right)^2 * 400\frac{\text{kg}}{\text{m}^3} = 1.44\frac{N}{\text{m}^2} = 14.4GPa$$

A decomposition of the wood beyond the desired treatment duration is preferably prevented by sterilisation of the wood samples with ethylene oxide (1 hour; 0.65 bars; 55° C.; approximately 1200 mg $C_2H_4O$/l). After such sterilisation the fungi discontinue their activity. The resonant wood then durably retains the achieved acoustic material quality Mq and its strength values.

Figure 6:
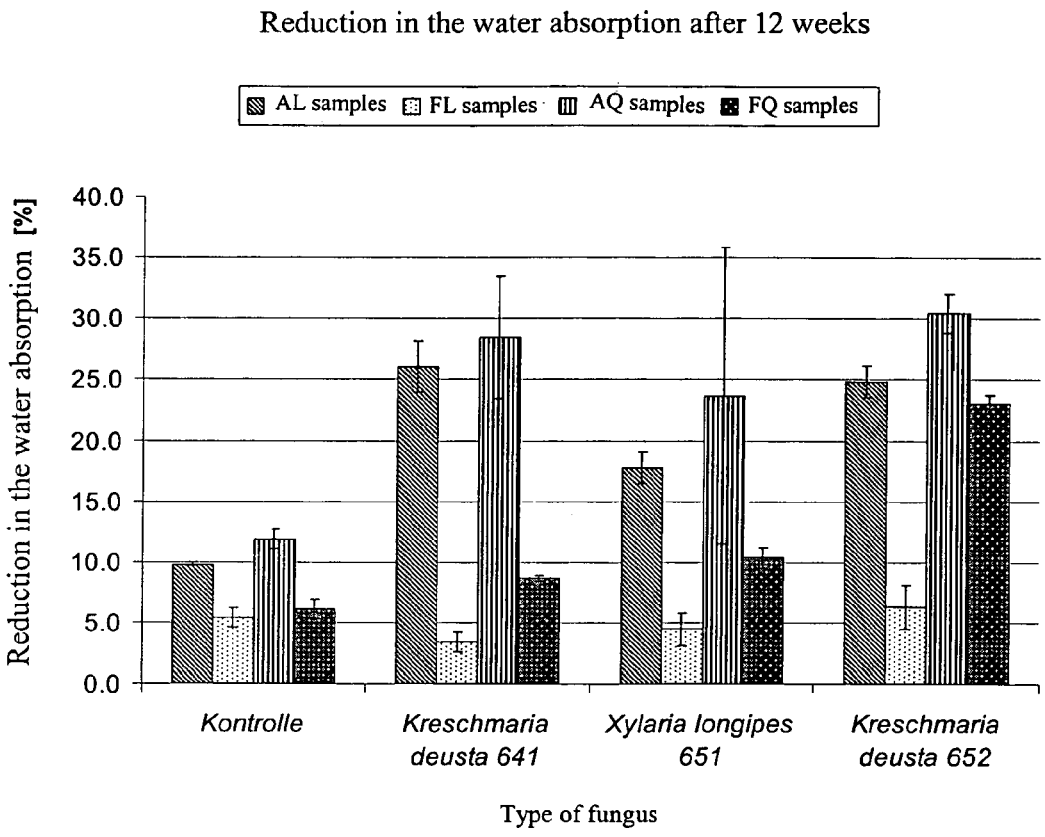
FIG. 6 shows the improvement of hygroscopic characteristics achieved in accordance with one aspect of the invention.

The improvement in the hygroscopic characteristics simultaneously achieved with the method according to the invention can be seen from FIG. 6 (in this case AL=longitudinal maple samples, FL=longitudinal spruce samples, AQ=transverse maple samples, FQ=transverse spruce samples). FIG. 6 shows the reduction in the water absorption (based on the kiln-dry weight) after 12 weeks of fungus treatment. By comparison with the untreated samples (control) in the transverse samples treated with fungus there is a significant reduction in the water absorption, and thus the hygroscopic characteristics (that is to say the swelling and shrinking of the wood) are substantially improved. In this case it should be noted that swelling and shrinking do not simple mean an increase or decrease in the wood body per se but also a change in the shape due to different amounts of shrinkage in the longitudinal, radial and tangential directions.

Resonant woods treated by the method according to the invention have been used as soundboards (top-plate and back-plate) of bowed stringed instruments. Studies of the sound quality of these instruments resulted inter alia in the following optimal variants for the choice of the type of fungus and the treatment duration of the particular resonant wood provided for the top-pate or the back-plate of the bowed stringed instrument:

a) The type of fungus and the treatment duration for the woods to be used as the top-plate or back-plate are chosen so that the quotient of the change in the velocity of sound of the longitudinal waves in the longitudinal direction relative to the wood fibre to the change in the velocity of sound of the longitudinal waves in the transverse direction relative to the wood fibre of the wood used for the top plate differs by a maximum of 25%, preferably by 8 to 12%, from the quotient of the wood used for the back-plate.

b) The type of fungus and the treatment duration for the woods to be used as the top-plate or back-plate are chosen so that the change in the velocity of sound of the longitudinal waves in the longitudinal direction relative to the wood fibre of the wood used for the top-plate differs by a maximum of 25%, preferably by 8 to 12%, from the corresponding change in the wood used for the back-plate.

c) The type of fungus and the treatment duration for the woods to be used as the top-plate or back-plate are chosen so that the change in the velocity of sound of the longitudinal waves in the transverse direction relative to the wood fibre of the wood used for the top-plate differs by a maximum of 25%, preferably by 8 to 12%, from the corresponding change in the wood used for the back-plate.

The invention claimed is:

1. A method for improving the acoustic characteristics of resonant wood for musical instruments, the method comprising:

exposing the resonant wood, at a temperature of 18 to 26° C. and a relative humidity of 60 to 80% for a treatment period of 6 to 15 weeks, to the action of a wood decomposing fungus in the form of Asco- und Basidiomycetes selected from the family of Leotiaceae, Polyporaceae, Schizophyllaceae, Tricholomataceae and Xylariaceae, the selected wood decomposing fungus and the treatment period providing that the ratio of the velocity of sound of the wood to the bulk density of the wood is increased while maintaining minimum strength values of the resonant wood.

2. The method as claimed in claim 1, wherein the following minimum strength values of the resonant wood are maintained:

modulus of elasticity along the wood fiber (in GPa):
spruce: 7;
maple: 4;
poplar: 4;

compression strength along the wood fiber (in $N/mm^2$ or MPa):
spruce: 24;
maple: 27;
poplar: 16; and compression strength across the fiber (in $N/mm^2$ or MPa):
spruce: 3;
maple: 6;
poplar: 1.5.

3. The method as claimed in claim 1, wherein the following minimum strength values of the resonant wood are maintained:

modulus of elasticity along the wood fiber (in GPa):
spruce: 10;
maple: 5.8;
poplar: 5.5;

compression strength along the wood fiber (in $N/mm^2$ or MPa):
spruce: 34;
maple: 38;
poplar: 23; and compression strength across the fiber (in $N/mm^2$ or MPa):
spruce: 4.2;
maple: 11;
poplar: 2.1.

4. The method as claimed in claim 1, wherein the treatment period is chosen such that a maximum value of the ratio of the velocity of sound of the wood to bulk density of the wood is achieved while maintaining minimum strength values of the resonant wood.

5. The method as claimed in claim 1, wherein the resonant wood is treated with the wood decomposing fungus at a temperature of 21 to 23° C. and a relative humidity of 65 to 75% for a treatment method of 8 to 12 weeks.

6. The method as claimed in claim 1 wherein the method is used to improve the acoustic characteristics of resonant woods to be employed as a top-plate and base-plate of a bowed stringed instrument, and wherein the selected fungus and the treatment period for the woods providing that the quotient of the change in the velocity of sound of the longitudinal waves in the longitudinal direction relative to the wood fiber to the change in the velocity of sound of the longitudinal waves in the transverse direction relative to the wood fiber of the wood to be used as top plate differs by a maximum of 25%, from the quotient of the wood to be used as back-plate.

7. The method as claimed in claim 6 wherein said quotient differs by a maximum of 8 to 12%.

8. The method as claimed in claim 1 wherein the method is used to improve the acoustic characteristics of resonant woods to be used as top-plate and base-plate of a bowed stringed instrument, and wherein the selected fungus and the treatment period for the woods provide that the change in the velocity of sound of the longitudinal waves in the longitudinal direction relative to the wood fiber of the wood to be used as top-plate differs by a maximum of 25%, from the corresponding change in the wood to be used as back-plate.

9. The method as claimed in claim 8 wherein said change differs by a maximum of 8 to 12%.

10. The method as claimed in claim 1 for improving the acoustic characteristics of resonant woods to be used as top-plate and base-plate of a bowed stringed instrument, wherein the selected fungus and the treatment period for the woods provide that the change in the velocity of sound of the longitudinal waves in the transverse direction relative to the wood fiber of the wood to be used as top-plate differs by a maximum of 25%, from the corresponding change in the wood to be used as back-plate.

11. The method as claimed in claim 10 wherein the change of velocity differs by 8 to 12%.

12. A resonant wood for musical instruments comprising a treated resonant wood having an increased ratio of the velocity of sound of the wood to the bulk density of the wood, as compared with the resonant wood when untreated, and having predetermined minimum strength values said treated resonant wood having been treated by exposure thereof, at a temperature of 18 to 26° C. and a relative humidity of 60 to 80% for a treatment period of 6 to 15 weeks, to the action of a wood decomposing fungus in the form of Asco- und Basidiomycetes selected from the family of Leotiaceae, Polyporaceae, Schizophyllaceae, Tricholomataceae and Xylariaceae.

13. A musical instrument comprising at least one resonant wood soundboard as claimed in claim 12.

14. A bowed string instrument comprising at least one resonant wood soundboard as claimed in claim 12.

* * * * *